US006208741B1

(12) United States Patent
Shennib et al.

(10) Patent No.: US 6,208,741 B1
(45) Date of Patent: Mar. 27, 2001

(54) BATTERY ENCLOSURE FOR CANAL HEARING DEVICES

(75) Inventors: Adnan Shennib, Fremont; Richard C. Urso, Redwood City, both of CA (US)

(73) Assignee: Insonus Medical, Inc., Newark, CA (US)

( * ) Notice: Subject to any disclaimer, the term of this patent is extended or adjusted under 35 U.S.C. 154(b) by 0 days.

(21) Appl. No.: 09/190,764

(22) Filed: Nov. 12, 1998

(51) Int. Cl.[7] ..... H04R 25/00

(52) U.S. Cl. ..... 381/323; 381/322; 381/324; 381/328; 181/130; 181/135

(58) Field of Search ..... 381/312, 322, 381/323, 324, 325, 328, 380; 181/135, 130; 600/25, 559; 607/55–57

(56) References Cited

U.S. PATENT DOCUMENTS 3,527,901 * 9/1970 Geib ..... 381/324
3,852,540 * 12/1974 Diethelm ..... 381/324
5,572,594 * 11/1996 Devoe et al. ..... 381/328
6,022,311 * 2/2000 Juneau et al. ..... 600/25
6,094,493 * 7/2000 Borowsky et al. ..... 381/328

* cited by examiner

*Primary Examiner*—Stella Woo
*Assistant Examiner*—Suhan Ni

(57) ABSTRACT

The present invention provides an extremely space efficient battery enclosure and battery replacement methods for miniature hearing devices that are deeply and entirely positioned within the ear canal of an individual. The battery enclosure is a thin encapsulation that is formed or fitted directly over the battery thus substantially assuming the shape of the encapsulated battery. The battery enclosure, containing mostly the battery, is fitted concentrically within the narrow cavity of the ear canal with the long axis of the enclosure and the battery therein positioned along the long axis of the oval ear canal. In one embodiment of the invention, the enclosure is disposable and is elastically expandable to fit over the battery during its replacement. In another embodiment, the battery enclosure is coated over the battery with protruding contacts forming a battery assembly ready for electrical connection to a miniature canal hearing device.

37 Claims, 5 Drawing Sheets

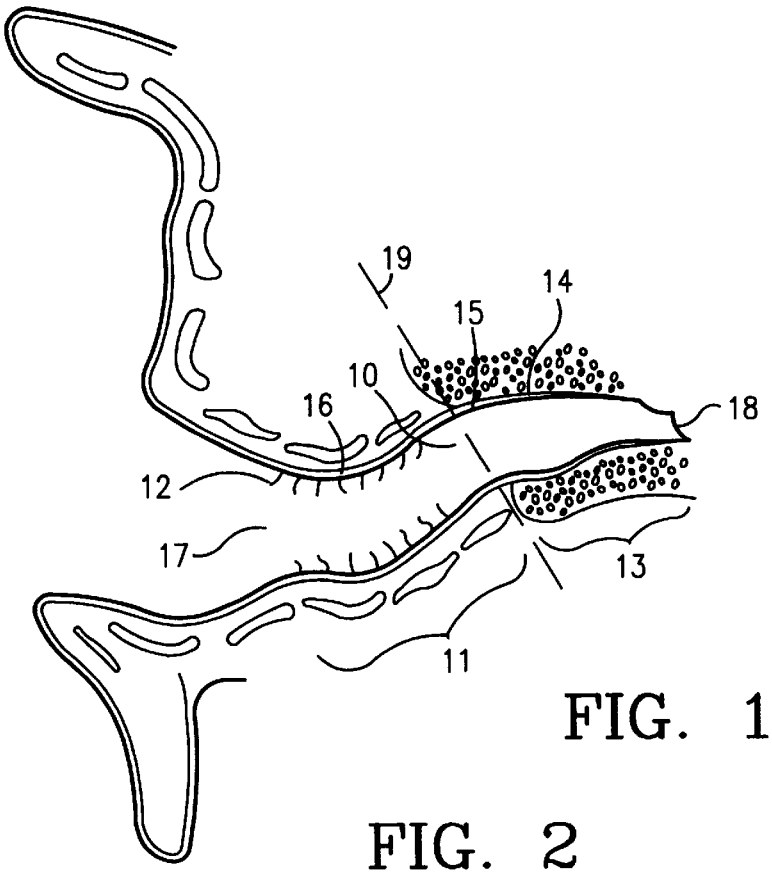
FIG. 1
FIG. 2
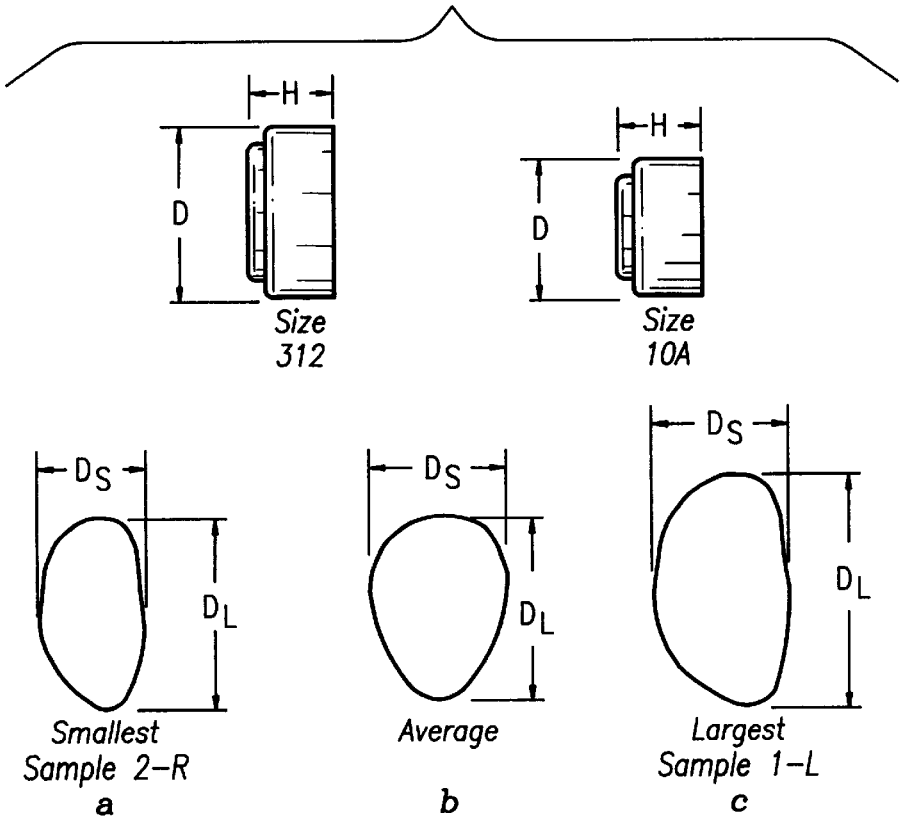

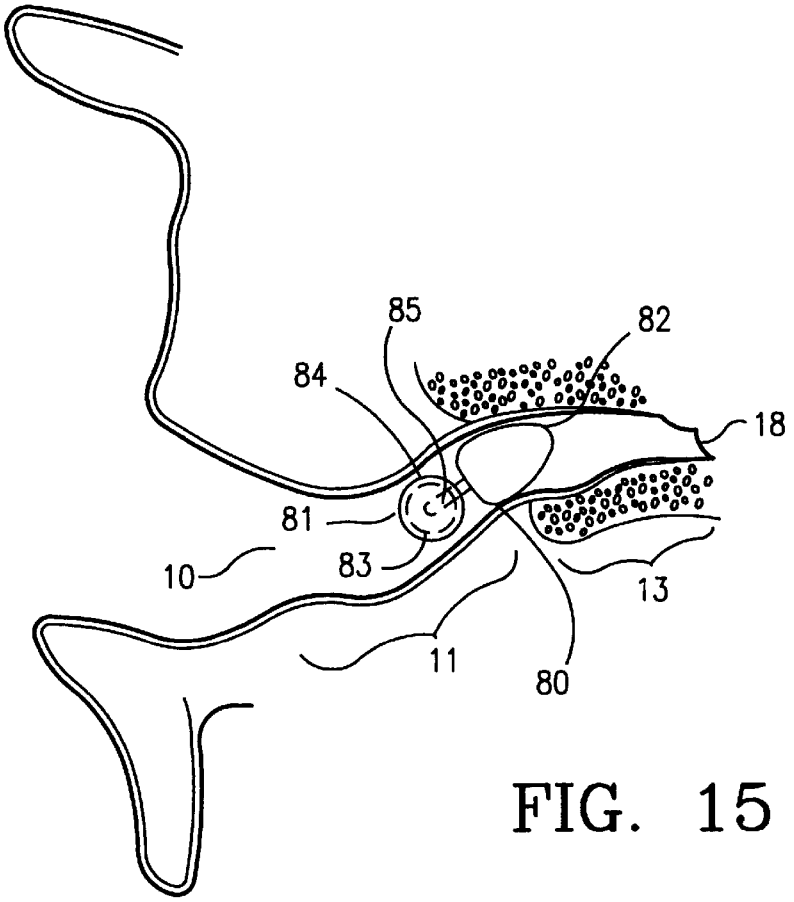
FIG. 15
FIG. 16
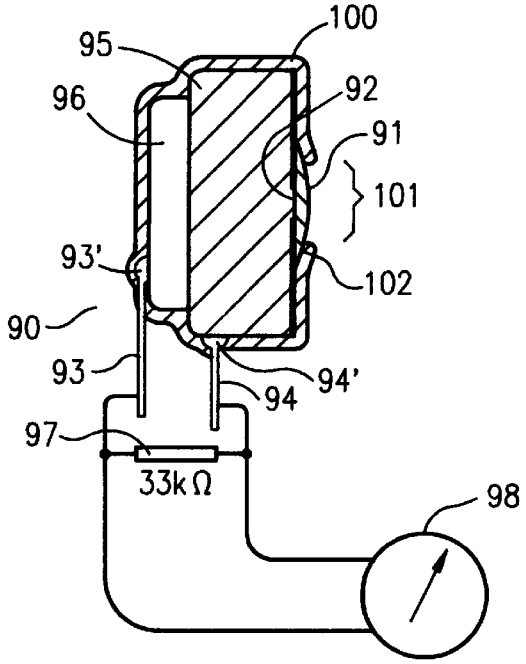

BATTERY ENCLOSURE FOR CANAL HEARING DEVICES

BACKGROUND OF THE INVENTION a. Technical Field

The present invention relates to hearing devices, and, more particularly, to hearing devices that are deeply positioned in the ear canal with improved energy efficiency, sound fidelity and inconspicuous wear.

b. Description of the Prior Art (1) Brief Description of Ear Canal Anatomy and Physiology The external acoustic meatus (ear canal) is generally narrow and tortuous as shown in the coronal view in FIG. 1. The ear canal 10 is approximately 23–29 mm long from the canal aperture 17 to the tympanic membrane 18 (eardrum). The lateral part, a cartilaginous region 11, is relatively soft due to the underlying cartilaginous tissue. The cartilaginous region 11 of the ear canal 10 moves in response to the jaw motions, which occur during talking, yawning, eating, etc. Cerumen (earwax, not shown) production and hair growth occur primarily in the lateral end of the ear canal within the cartilaginous region. The medial part, a bony region 13 proximal to the tympanic membrane, is rigid due to the underlying bony tissue. The skin 14 in the bony region 13 is thin (relative to the skin 16 in the cartilaginous region) and is sensitive to touch or pressure. There is a characteristic bend 15 that roughly occurs at the bony-cartilaginous junction 19. The magnitude of this bend varies significantly among individuals. There is no earwax production or hair in the bony part of the ear canal. The ear canal 10 terminates at the tympanic membrane 18.

A cross-sectional view of the typical ear canal 10 (FIG. 2) reveals generally an oval shape with a long diameter ($D_L$) in the vertical axis and a short diameter ($D_S$) in the horizontal axis. The canal dimensions vary significantly among individuals as shown below in the section titled Experiment-A.

(2) The Challenges of Deep Canal Fittings

The benefits of placing a hearing device deep in the ear canal are many. They include improved high frequency response, less distortion, reduction of feedback and improved telephone use (Chasin, M. *CIC* [*Completely In the Canal*] *Handbook,* Singular Publishing, pp 10–11, 1997, referred to hereinafter as "Chasin"). A major benefit for "an invisible hearing device" for the user is cosmetic in nature since hearing aid use is often associated with aging and disability.

A conventional deep canal hearing device 50, shown in FIG. 3, typically includes a battery 52, a microphone 53, an amplifier 54 and a receiver 55 (speaker), among other components (not shown), all of which are housed within an outer shell 51 composed of acrylic or plastic material. The battery enclosure, comprising battery door 56, battery compartment with contacts (not shown), and outer shell 51, is conventionally positioned in the lateral end of the hearing device 50 occupying the lateral end of the ear canal as shown in FIG. 3. The most lateral structure of a hearing device is referred to in the hearing aid industry as the "face-plate" 57 which is attached to the shell 51 and houses the battery door for access to the battery compartment and the battery within (for example, see U.S. Pat. No. 4,272,591 to Brander, U.S. Pat. No. 4,803,458 to Trine et al., and U.S. Pat. No. 5,675,657 to Giannetti).

Since the battery enclosure is a permanent component of a conventional hearing device, the enclosure must be durable to last the life of the hearing device. For this reason alone, the thickness of shells in conventional canal hearing devices typically ranges between 0.5 to 0.7 millimeter (mm).

With continued improvements in miniaturization of hearing aid components, the battery has emerged as the largest single component in miniature hearing devices. For this reason, among others, the battery is typically positioned laterally within the cartilaginous region 11 of the ear canal, a region with relatively larger dimensions as compared with medial regions of the ear canal.

Unfortunately, fitting a hearing device deeper with prior art battery enclosures is virtually impossible for most hearing impaired individuals due to space limitations in the deeper areas of the ear canal. As demonstrated in Experiment-A (described below) employing measurements of ear impressions from human cadavers, the dimensions of the typical ear canal prohibit placement of batteries with conventional enclosures in the vicinity of the bony-cartilaginous junction 19.

Resorting to smaller batteries, and thus a smaller enclosure, to reduce the overall size of the device is not practical for most users who expect a prolonged use of their batteries prior to depletion and replacement.

Another problem associated with battery enclosure in conventional hearing aid designs is caused by the occlusion of the ear canal by the housing of the device. Occlusion related problems include:

(i) Discomfort, irritation and even pain may occur attributable to canal abrasion caused by frequent insertion and removal of an occluding hearing device. Due to canal discomfort and abrasion, hearing devices are frequently returned to the manufacture in order to improve the custom fit and comfort (Chasin, pp. 43–44). "The long term effects of the hearing aid are generally known, and consist of atrophy of the skin and a gradual remodeling of the bony canal. Chronic pressure on the skin lining the ear canal causes a thinning of this layer, possibly with some loss of skin appendages" (Chasin, p. 58).

(ii) The occlusion effect is a common acoustic problem caused by the occluding hearing device. It is manifested by the perception of a person's own-voice ("self-voice") being loud and unnatural compared to that with the open ear canal. This phenomenon is sometimes referred to as the "barrel effect" since it resembles the experience of talking into a barrel. The occlusion effect, which may be experienced by plugging the ears with fingers while talking, is generally related to self-voice resonating within the ear canal. In the ear canal occluded by a conventional hearing device 10 (FIG. 3), a large portion of the self-voice 20, originating from the larynx (voice-box) and conducted upward by various body structures, is directed at the tympanic membrane 18, as shown by arrow 21. Some of the sound energy escapes to the outside through the occluded hearing device as shown by arrow 22. The residual "trapped" sound energy 21 is perceived by the individual wearing the device as loud or unnatural. In the open (non-occluded) ear canal, a relatively larger amount of self-voice 22 is allowed to escape, and the residual sound 21 directed at the tympanic membrane 18 is relatively smaller. This represents what is perceived as natural self-voice. For hearing aid users, the occlusion effect is inversely proportional to the residual volume of air between the occluding hearing device and the tympanic membrane. Therefore, the occlusion effect is considerably alleviated by a deeper insertion of a device within the ear canal.

(3) State of the art in Battery Enclosure in Hearing Devices

As mentioned above, prior art hearing devices typically comprise a battery compartment within an outer shell having an attached face-plate. The shell and the attached face-plate are typically composed of rigid acrylic or plastic material. The shell typically occludes the ear canal.

U.S. Pat. No. 5,201,008 to Arndt et al. describes an open-topped battery compartment (24 in FIG. 1) that is first contained within a first housing (22 in FIG. 1) and subsequently contained in a second housing (12 in FIG. 1, where the Figure numbers mentioned with respect to the patent refer to those in the patent itself). U.S. Pat. No. 5,701,348 to Shennib et al. also describes a battery compartment (15 in FIG. 3) contained in outer housing (13 in FIG. 3) made of rigid non-resilient material. In the above mentioned inventions, the outer housing, containing the battery compartment, is too large to fit in the deeper portion of the ear canal, especially when considering other components (i.e. the microphone) which also reside in the same outer housing.

U.S. Pat. No. 3,701,862 to Vignini, U.S. Pat. No. 5,588,064 to McSwiggen et al., and U.S. Pat. No. 5,687,242 to Iburg all describe a moving battery compartment which activates a switch upon its movement. The combined battery compartment-switch part in the above inventions is space efficient for a hearing device positioned in the outer part of the ear (FIG. 1 of McSwiggen, for example). However, the combined size of the battery compartment, electrical contacts, and enclosing housing similarly prohibits the device from fitting in the deeper portion of the ear canal, particularly at the bony-cartilaginous junction 19 or beyond.

U.S. Pat. No. 4,931,369 to Hardt et al. describes a battery enclosure comprising an electrical contact arrangement within the housing and cover (FIG. 1). Since the battery is housed in a chamber formed by the door and the housing, having dimensions substantially corresponding to the dimensions of the button battery, a battery compartment is eliminated thus providing improved space efficiency.

However, in the disclosure of the '369 patent, as well as the prior art described elsewhere including some of the patents mentioned above, the outer enclosure surrounding the battery also encloses other components such as microphone and amplifier. This contiguous enclosure causes the overall package to increase beyond the dimensions of many ear canals, particularly at the bony-cartilaginous junction and beyond.

It is a principal objective of the present invention to provide a space efficient: battery enclosure for positioning devices deep in the ear canal. Another objective of the invention is to provide an enclosure which minimizes the occlusion of the ear canal.

SUMMARY OF THE INVENTION

The present invention provides an extremely space efficient battery enclosure and battery replacement method for miniature hearing devices that are deeply and entirely positioned within the ear canal of an individual. The battery enclosure is a thin encapsulation that is formed or fitted directly over the battery thus substantially assuming the shape of the encapsulated battery. The battery enclosure, containing mostly the battery, is fitted concentrically within the narrow cavity of the ear canal. In one embodiment of the invention, the enclosure is removably disposable and is elastically expandable to fit over the battery during its replacement. In another embodiment, the battery enclosure is coated over the battery with protruding contacts forming a disposable battery assembly ready for electrical connection to a miniature hearing device.

The battery enclosure of the invention eliminates bulky and contiguous housings commonly used in conventional hearing aids. The space efficient design of the battery enclosure facilitates insertion and removal of an associated hearing device, particularly for small and tortuous canals. The design also minimizes occlusion of the ear canal, thus minimizing occlusion effects commonly experienced with prior art designs.

BRIEF DESCRIPTION OF THE DRAWINGS

The above and still further objectives, features, aspects and attendant advantages of the present invention will become apparent from the following detailed description of certain preferred and alternate embodiments and method of manufacture thereof constituting the best mode presently contemplated of practicing the invention, when taken in conjunction with the accompanying drawings, in which:

FIG. 1 is a coronal view of the external ear showing the ear canal;

FIG. 2 includes cross-sectional views of the ear canal at the bony-cartilaginous junction for a small canal (part a), an average size canal (part b) and a large canal (part c), together with illustrative dimensions of standard button cell hearing aid batteries, sizes 10A and 312, for comparison;

FIG. 15 is a view of the battery enclosure of the invention in an alternate hearing device configuration, positioned deep within the ear canal; and FIG. 16 is a view of a test setup for an air-permeable moisture-proof battery enclosure for zinc-air battery.

DETAILED DESCRIPTION OF PRESENTLY PREFERRED EMBODIMENTS AND METHODS OF THE INVENTION

The present invention, shown in illustrative embodiments in FIGS. 4–16, provides a space efficient battery enclosure and replacement methods for miniature hearing devices that are deeply and entirely positioned in the ear canal. The battery enclosure is separate (and separable) from any other enclosure of the associated hearing device and is thin and substantially conforms to the shape of the battery. The battery enclosure represents the outermost surface of the battery section 35 with no additional housing as with conventional hearing devices. The battery enclosure may partially come in contact with the skin of the ear canal of the wearer (user), and thus must be biocompatible. In the preferred and alternate embodiments of the invention to be described herein, the battery enclosure is non-occluding to the ear canal and its contact with the skin in minimal, if any, depending on the size of the ear canal of the individual.

Figure 5:
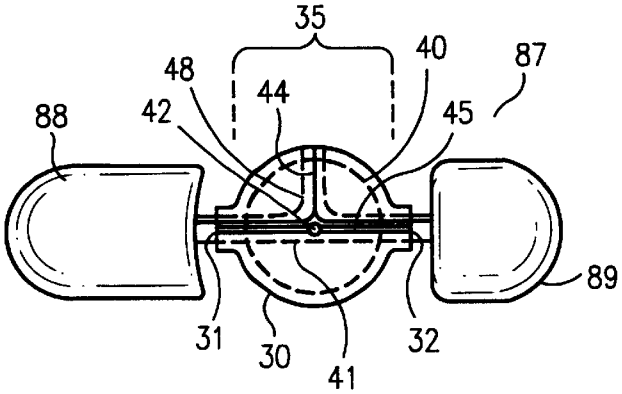
FIG. 5 is a detailed view of the battery section enclosure of FIG. 4, having substantially the shape of the battery and encapsulating the battery and electrical contacts of the hearing device.
Figure 7:
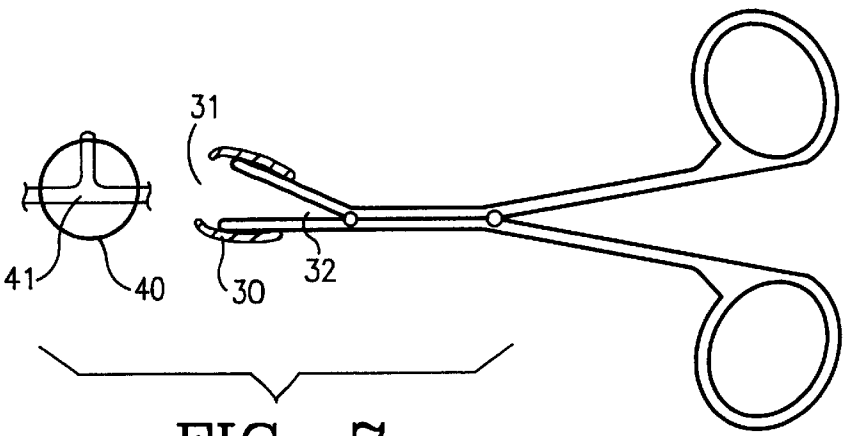
FIG. 7 is a sectional view of an elastically expandable battery enclosure on a placement tool for placement over battery and electrical contacts of hearing device.

A preferred embodiment of battery enclosure 30, shown in FIGS. 4–7, is removably disposable and is made of thin and elastically expandable material such as silicone or like material, for example, which is formed in or assumes the shape of the enclosed button cell battery 40 and connector 41. The associated hearing device 87 comprises hearing aid components (not shown) housed separately in a lateral section 88 and a medial section 89 proximal to the eardrum and within the bony section 13 (FIG. 1) of the ear canal 10. The enclosure 30, shown in greater detail in FIG. 5, encapsulates connector 41, which provides electrical and mechanical connection between the battery 40 and the associated hearing device 87. Connector 41 embeds electrical conductors 44 and 45. The connector 41 is flat and thin, thus minimizing the overall size of the battery enclosure 30. The connector comprises first and second battery contacts 42 and 43 (FIG. 6) which electrically connect to first (+) and second (−) battery terminals 46 and 47, respectively. Second battery contact 43 is connected to battery terminal 47 opposite the connector 41 via insulated electrical conductor 44 which crosses the battery over its cross section al perimeter. The crossing insulated electrical conductor 44 is embedded in crossing connector extension 48 (FIG. 5).

Figure 6:
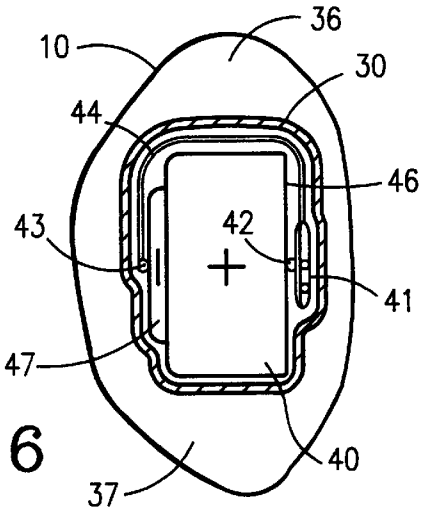
FIG. 6 is a cross-sectional view of the battery section positioned in the ear canal at the bony-cartilaginous junction area, showing top and bottom spaces which minimize occlusion effects.

The battery enclosure 30 is positioned with its long axis along the long axis of the oval ear canal as shown in FIG. 6. As a result of its compact size and shape, the battery enclosure 30 minimally occludes the ear canal 10, and typically allows formation of space 36 above and space 37 below its location when positioned in the ear canal due to the oval shape of the ear canal. This minimizes occlusion-related problems such as discomfort and the acoustic occlusion effect.

The disposable battery enclosure 30 (FIG. 5) has a lateral opening 31 and a medial opening 32 for inserting the battery 40 within the enclosure.

In the process of replacement of a depleted battery, the enclosure 30 is removed by either peeling or cutting via a pair of miniature scissors. After discarding the removed enclosure and the depleted battery and connecting the new battery to electrical contacts 42 and 43 of the connector 41, a new enclosure is then positioned over the battery by an appropriate means. In the example shown in FIG. 7, the new enclosure is first stretched with an appropriate tool, such as alligator forceps, and subsequently released over the battery and the connector to enclose them. The enclosure is designed to fit tightly such that it seals and protects the battery 40 and the contacts 41 from moisture, earwax and other debris which may be present in the ear canal.

Figure 3:
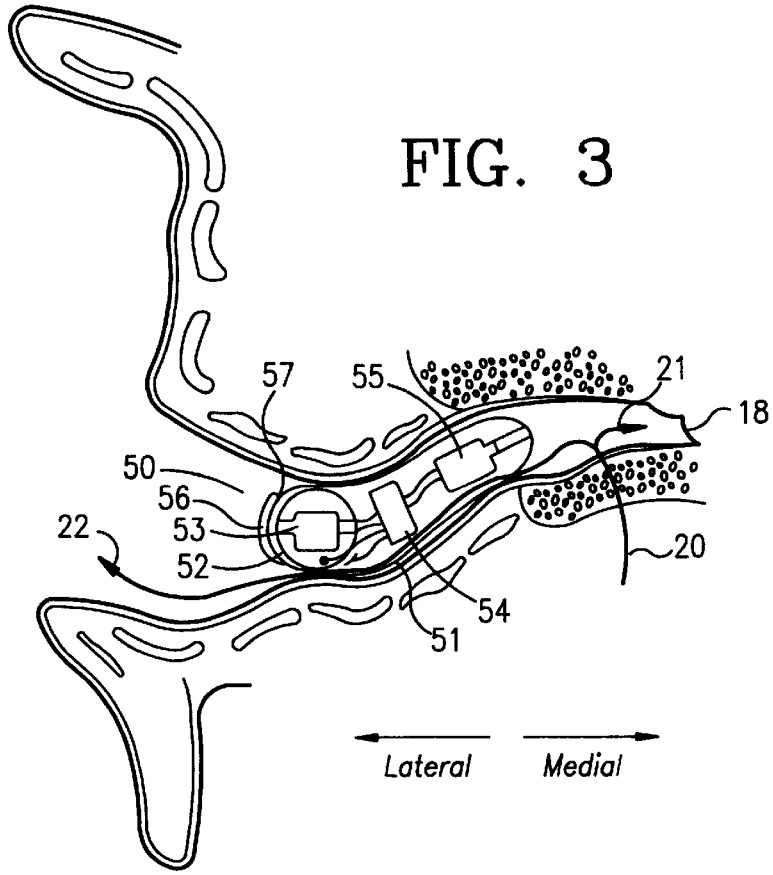
FIG. 3 is a view of a conventional canal hearing device housing a battery and other components, positioned within the ear canal, and depicting the occlusion effect.
Figure 4:
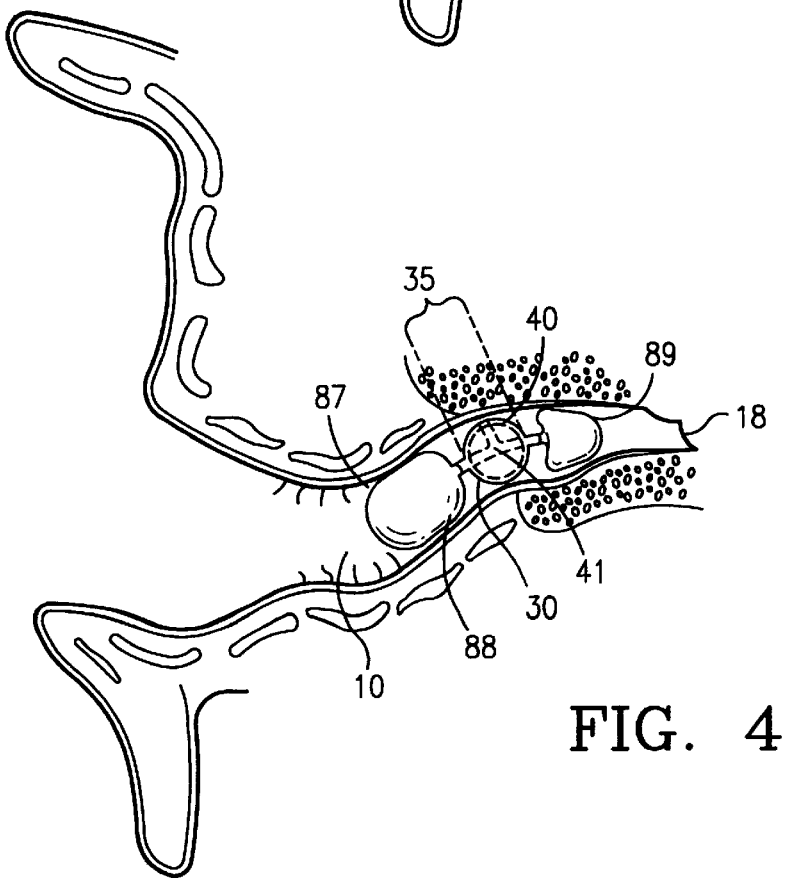
FIG. 4 is a view of a hearing device deeply inserted in the ear canal with battery section enclosure according to a preferred embodiment of the present invention.
Figure 8:
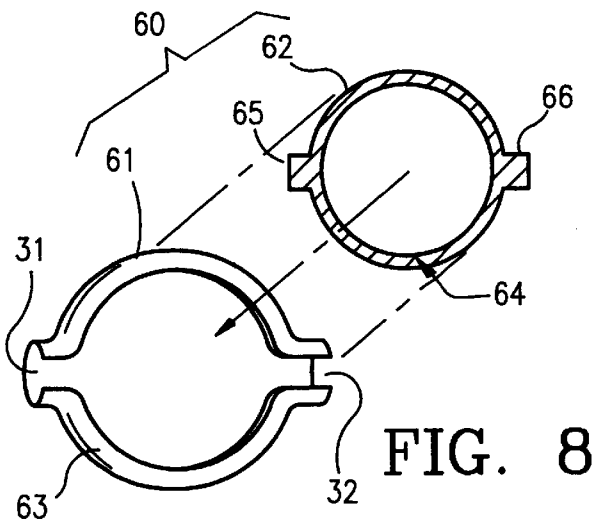
FIG. 8 is an enlarged exploded side view of an alternate embodiment of the invention comprising a two part enclosure including a cap.
Figure 9:
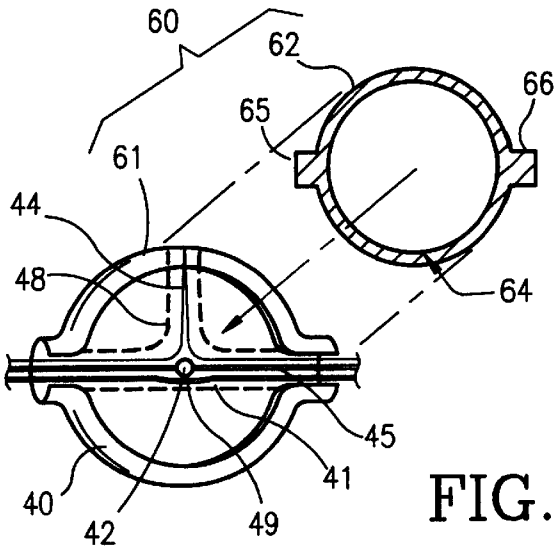
FIG. 9 is a further enlarged exploded side view of the two part enclosure of FIG. 8, for housing the battery and electrical contacts.

In another preferred embodiment, shown in FIGS. 8 and 9, the battery enclosure 60 comprises two parts, namely, a flexible base 61 with a cap 62. The flexible base 61 comprise a circular ledge 63 which bends and allows the battery 40 and connector 41 to be inserted within the base portion as shown in FIG. 9. The connector 41, which provides electrical and mechanical connection between the battery and the associated hearing device, comprises electrical contacts 44, 45 and 49. The base 61 has lateral and medial openings 31 and 32 corresponding to lateral and medial necks 65 and 66 of the cover or cap 62.

The cap 62 is attached to the base 61 via adhesive 64 applied on the rim of the cap 62 as shown. The cap 62 may alternatively be attached to the base 61 via a snap mechanism (not shown) of conventional type in the art of miniature mechanical designs. Similarly the removable battery enclosure 60 may be made disposable and fits tightly over the battery and the connector in order to minimize the size and to seal the enclosed parts.

The enclosure invention according to FIGS. 8 and 9 may alternatively be made of an elastically rigid material such as plastic or like material, thus allowing a degree of flexibility for insertion of the battery therein or for accommodating a snap mechanism for the cap member. A prototype of the embodiment of the invention according to FIGS. 8 and 9 was fabricated using polypropylene material (#100–3513 distributed by Henry Schein, Inc.). The material was thermoformed into the shape of the battery resulting in an enclosure of 0.22 mm in thickness.

Figure 10:
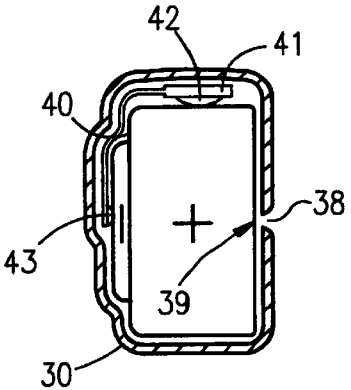
FIG. 10 is a cross-sectional view of an enclosure with miniature air channel for venting of zinc-air batteries.

Since zinc-air batteries have the highest energy density with stable output voltage, they are commonly used in hearing aid applications. However, these batteries require air exposure in order to activate their electrochemical reaction. In order to alleviate the need for air exposure, the enclosure of the present invention must allow for air to reach the battery hole of zinc-air batteries. FIG. 10 shows an enclosure 30 with an air channel 38 positioned over battery air hole 39. The enclosure 30 also encapsulates connector 41, alternatively positioned on the top of battery 40. Other designs and configurations for providing an enclosure with an air channel for the internal battery are possible as will be apparent to persons skilled in the art from the foregoing description.

The battery enclosure may cover the air hole 39 if made from a material that is air-permeable and moisture-proof A liquid bandage material, designed for wound-cover applications, was tested over battery air hole 39 as disclosed in the section below titled Experiment-B.

Figure 12:
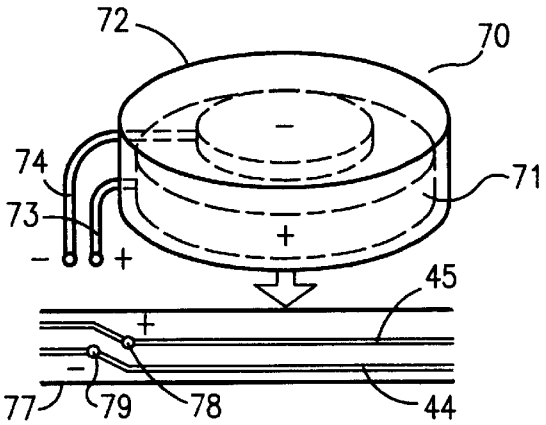
FIG. 12 is a perspective view of the disposable battery assembly embodiment of FIG. 11, showing attachment to contacts of a hearing device.

In yet another alternate embodiment of the invention, shown in FIGS. 11–14, the battery 71 and protruding electrical contacts 73 and 74 are coated with an enclosure 72 forming a disposable battery assembly 70. A positive electrical contact 73 is connected to the positive terminal 75 of battery 71 via solder contact 73' (FIG. 11) and negative electrical contact 74 is connected to negative terminal 76 of battery 71 via solder contact 74'. The protruding electrical contacts, 73 and 74, may be alternatively connected to battery terminals via a conductive adhesive or other connective means known in the art of electromechanical design. FIG. 12 shows the battery assembly, substantially in the shape of the enclosed battery, being attached to a connector 77 having receiving contacts 78 and 79 for receiving electrical contacts 73 and 74, respectively. Conductors 44 and 45 carry electrical energy to electrical components of the associated hearing device (not shown). The assembly contacts 73 and 74 may be alternatively attached to receiving contacts positioned at any appropriate part of the associated hearing device.

Figure 13:
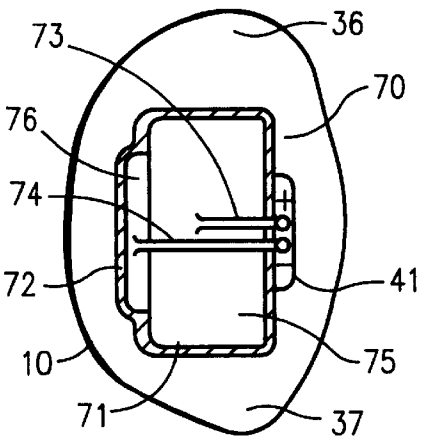
FIG. 13 is a cross-sectional view of the disposable battery assembly, attached to connector of hearing device, deeply positioned in the ear canal.

FIG. 13 shows a cross section of the battery assembly 70 deeply positioned in the ear canal 10 with top and bottom spaces 36 and 37 forming in the oval canal. These spaces obtained with this embodiment minimize occlusion effects commonly experienced with custom hearing devices.

Figure 14:
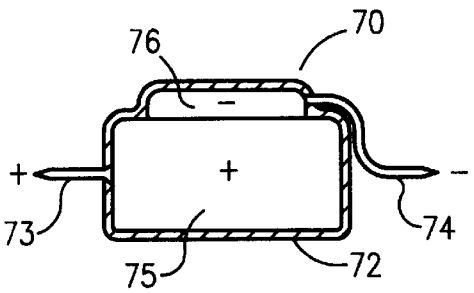
FIG. 14 is a cross-sectional view of an alternate embodiment of a disposable battery assembly showing an alternate contact arrangement.

FIG. 14 shows another embodiment of the battery assembly 70 with an alternate arrangement of contacts 73 and 74. It will be clear from the foregoing description that the contacts may be arranged and oriented in any number of ways as necessary to accommodate the receiving contacts of a particular mating connector.

The hearing device associated with battery section of the present invention is not limited to the specific configuration shown in FIGS. 4–14. For example, a battery section may be positioned laterally with respect to the associated hearing device as shown in FIG. 15. The hearing device 80 comprises a battery section 81 lateral to a medial section 82. The battery section 81 comprises an enclosure 84 and battery 83 and connects to the medial section via connector 85. The battery section is shown substantially in the cartilaginous region 11 of the ear canal 10 while the medial section 82 of the device 80 is positioned well into the bony region 13.

The present invention shown in the above embodiments enables an associated hearing device to fit deeply in the ear canal with larger battery than possible with conventional hearing devices. For example, with reference again to FIG. 2, in which exemplary batteries are shown substantially to scale relative to smallest, average, and largest sample ear canal sizes for comparison purposes, a size-312 battery may be fitted in many ear canals previously limited to the smaller size-10A. This allows a CIC hearing device to operate for a significantly longer period of time than had heretofore been possible.

The present invention, shown with button cell batteries in the above embodiments, is equally suited for other battery shapes and configurations as they are likely to be available in future hearing aid applications. The battery enclosure of the present invention, regardless of the type of battery used, is substantially in the shape of enclosed battery. The thickness of the enclosure is not to exceed 0.3 mm for the preferred embodiments of the invention.

Two experimental studies conducted by the inventors employing above-described embodiments of the present invention will now be described.

Experiment A

The dimensions of ear canals were measured from ten canal impressions obtained from adult cadaver ears. The long and short diameters ($D_L$ and $D_S$) of cross-sections at the bony-cartilaginous junction were measured and tabulated below. The diameters were measured across the widest points of the cross-section impression as shown in FIGS. 2*a*, 2*b* and 2*c*. The diameter (D) and height (H) of two standard button cell hearing aid batteries, sizes 10A and 312 (manufactured by Panasonic) were also measured and tabulated. All measurements were taken by a digital caliper (model CD-6"CS manufactured by Mitutoyo). The impression material used was low viscosity hydrophilic vinyl polysiloxane (manufactured by Densply/Caulk) using a dispensing system (model Quixx manufactured by Caulk). From the ten impressions taken, ten actual-size ear canal models were fabricated by dip-forming clear acrylic material (Audacryl-acrylic manufactured by Esschem).

Figure 11:
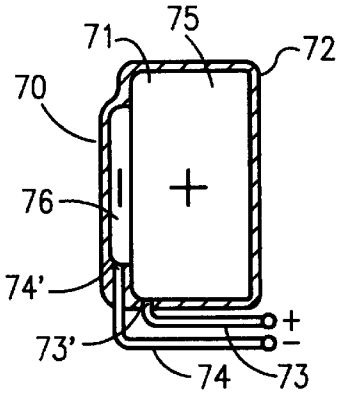
FIG. 11 is a cross-sectional view of another alternate embodiment of the present invention constituting a disposable battery assembly.

Two battery assemblies according to the embodiment shown in FIG. 11 were fabricated and inserted in each of the ten ear canal models up to the bony-cartilaginous junction area. The first assembly used a size-10A battery and the second used a size-312 battery. The batteries were encapsulated with silicone conformal coating (model MED 10-6605 manufactured by NuSil). Thickness of the coating measured approximately 0.05 mm, thus adding negligible dimensions to the battery assemblies.

The thickness of several shells of conventional hearing devices measured between 0.5 mm and 0.7 mm. For a conventional hearing device enclosing size-10A battery, the added dimensions of (1) the shell (0.5 mm or more, adding a minimum of 1 mm to the dimensions) and (2) other enclosed components, prohibited insertion of the device at the bony-cartilaginous junction area for at least five of the above ear canals (2-R, 2-L, 3-R, 3-L and 7-L). This is further exacerbated by the fact that ear canals are often tortuously contoured thus making access to the deeper area painful if not impossible for individuals wearing the device. For a conventional hearing device with size-312 battery, deep fitting is only likely for very large ear canals, such as 1-R and 1-L.

| Sample # | Short Diameter $D_S$ in mm | Long Diameter $D_L$ in mm |
|---|---|---|
| 1-R | 8.1 | 10.7 |
| 1-L | 8.3 | 12.2 |
| 2-R | 4.0 | 8.9 |
| 2-L | 4.4 | 8.8 |
| 3-R | 4.7 | 6.7 |
| 3-L | 4.9 | 6.5 |
| 4-R | 6.5 | 9.6 |
| 5-R | 7.2 | 8.4 |
| 5-L | 7.6 | 9.4 |
| 7-L | 5.1 | 6.7 |
| Average | 6.1 | 8.8 |
| 10A Bat. | 3.4 (H) | 5.8 (D) |
| 312 Bat. | 3.5 (H) | 7.8 (D) |

The first battery assembly (size-10A) was successfully inserted up to the bony-cartilaginous junction in all of the ten ear canal models, including the smallest ear canal (2-R) having dimensions of 4.0×8.9 mm ($D_S \times D_L$) as shown in FIG. 2. Furthermore, the battery assembly was inserted even deeper, well into the bony region, for all ear canals with the exception of 2-R.

The second battery assembly (size-312) was successfully inserted up to the bony-cartilaginous junction in five of the ten ear canal models. This is particularly significant, since size-312 batteries are virtually excluded from conventional canal devices due to their excessive size in conjunction with conventional enclosure designs.

The results confirm that the present invention is more space efficient and would allow an associated hearing device to fit in the bony-cartilaginous junction area and beyond for most adult individuals with size-10A batteries and a significant percentage of adult individuals with size-312 batteries.

Experiment B

A test was devised to examine the concept of air venting an zinc-air battery while providing a moisture-proof enclosure according to the present invention. An zinc-air button cell battery, size 10A (Model DAI10 manufactured by Duracell) was coated with an air-permeable layer of liquid-bandage (New Skin®) over its vent hole located at the center of the positive terminal. The test configuration employed is shown in FIG. 16. The battery assembly 90 was connected to an external 33 K ohm load 97. Liquid-bandage 91 was indirectly applied after a small amount of mineral oil (not shown) was first applied on the vent hole (92). The pre-application of mineral oil assisted in spreading the liquid-bandage evenly and thinly over the battery vent hole. A relatively thick layer of liquid-bandage was previously tested, leading to starving the battery from needed air and causing the voltage to drop rapidly to an inoperable level. The thin layer of liquid-bandage over mineral oil cured within 10 minutes of its application.

A pair of lead wires (93 and 94) were soldered to the positive and negative terminals 95 and 96 via solder contacts 93' and 94'. Lead wires 93 and 94 were connected to a voltmeter 98 for periodic measurement of the voltage.

The battery assembly 90 was also coated with a thin layer of silicone conformal coating 100 (model MED 10-6605 manufactured by NuSil) except at relieved area 101 over the vent hole area which is covered by the liquid-bandage 91 as shown in FIG. 16. There was an overlap area 102 between the layers of conformal coating 100 and liquid-bandage 91 in order to provide a seal against moisture.

The battery voltage, nominally at about 1.35 volts, was held at an operable level above 1.2 volts continuously for approximately 1800 hours (75 days) prior to battery depletion. There was no visible corrosion of the battery at the end of the test period when inspected under a microscope (model OPMI-1 manufactured by Zeiss). After depletion of the battery, the liquid-bandage 91 and the conformal coating 100 were removed and the thickness of each coating was measured. The air-permeable liquid-bandage layer measured 0.02 mm. The thickness of the silicone conformal coating was approximately 0.05 mm.

The air-permeable layer allowed the zinc-air battery to function properly while providing moisture protection for the battery during its 75 days of operation.

Although a presently contemplated best mode of practicing the invention has been described herein, it will be recognized by those skilled in the art to which the invention pertains from a consideration of the foregoing description of presently preferred and alternate embodiments and methods of fabrication thereof, that variations and modifications of this exemplary embodiments and methods may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A battery section for use with a hearing device to enable deep insertion of the hearing device entirely within the ear canal of a wearer, said battery section comprising:

a thin enclosure substantially conforming to the shape of a battery to be enclosed therein, said enclosure being configured and adapted to be selectively separable from its associated hearing device and to allow insertion therein and removal therefrom of said battery to accommodate replacement of said battery when depleted, said enclosure constituting the outermost enclosure of said battery therein and being in direct exposure to the environment of the ear canal when the hearing device is inserted therein, a connector incorporated in said enclosure for electrical connection to said battery, and said enclosure exclusively surrounding said connector and said batter when enclosed therein, and means for electrically and mechanically connecting said connector to an associated hearing device, whereby to concurrently couple said enclosure to said hearing device, said battery section being non-occlusive within the ear canal when placed therein.

2. The battery section of claim 1, wherein said enclosure is elastically expandable to ease insertion and removal of said battery enclosed therein.

3. The battery section of claim 2, wherein said elastically expandable enclosure has a lateral opening for insertion and removal of said battery.

4. The battery section of claim 2, wherein said elastically expandable enclosure has a medial opening for insertion and removal of said battery.

5. The battery section of claim 2, further including a placement tool for expanding and placing said elastically expandable enclosure over said battery.

6. The battery section of claim 2, wherein said elastically expandable enclosure is composed of silicone or like material.

7. The battery section of claim 1, wherein said enclosure comprises a pair of mating members.

8. The battery section of claim 7, wherein said pair of mating members consist of a base member and a cap member.

9. The battery section of claim 8, wherein said cap member is adhesively attached to said base member.

10. The battery section of claim 8, wherein said cap member is attached to said base member by a snap closure mechanism.

11. The battery section of claim 1, wherein said enclosure includes an air channel for venting of said battery enclosed therein.

12. The battery section of claim 1, wherein said enclosure is at least partially fabricated from air-permeable material.

13. The battery section of claim 1, wherein said enclosure is at least partially fabricated from moisture-proof material.

14. The battery section of claim 1, wherein said enclosure is configured and sized to provide a substantial air space dimension between said enclosure and said ear canal when fully inserted into said ear canal, for minimizing occlusion thereof.

15. The battery section of claim 1, wherein said enclosure is a disposable member.

16. The battery section of claim 1, wherein said enclosure is composed of thermoforned material.

17. The battery section of claim 1, wherein said enclosure is composed of plastic or like material.

18. The battery section of claim 1, wherein said enclosure is composed of silicone or like material.

19. The battery section of claim 1, wherein said enclosure has a thickness not exceeding 0.3 mm.

20. The battery section of claim 1, wherein said enclosure is configured and sized to enable full insertion thereof to or beyond the bony-cartilaginous junction area of the ear canal.

21. The battery section of claim 1, wherein said enclosure is configured and adapted to conform to the shape of a button cell type battery.

22. The battery section of claim 1, wherein said enclosure is configured and adapted to align the long axis of a battery enclosed therein along the long axis of the oval ear canal.

23. The battery section of claim 1, wherein said enclosure is composed of biocompatible material.

24. A disposable battery assembly for use with a hearing device to enable deep insertion of the hearing device entirely within the ear canal of a wearer, said battery assembly comprising:

a battery, a thin enclosure substantially conforming to the shape of said battery and configured and adapted for exclusive snug enclosure of said battery therein, said enclosure constituting the outermost enclosure of said battery therein and being in direct exposure to the environment of the ear canal when said hearing device is inserted therein, an electrical connector incorporated in said enclosure and electrically connected to terminals of the battery therein to deliver electrical energy therefrom, and electrical contacts of said electrical connector engageable from outside said enclosure for separably electrically and mechanically connecting said battery assembly to an associated hearing device, whereby said battery assembly is removable from the connected hearing device and disposable when said battery is depleted, said battery assembly being non-occlusive within the ear canal when placed therein.

25. The battery assembly of claim 24, wherein said electrical contacts protrude from said enclosure to enable engagement thereof for connection of said battery assembly to an associated hearing device.

26. The battery assembly of claim 24, wherein said enclosure has an air channel for venting said enclosed battery.

27. The battery assembly of claim 24, wherein said enclosure is at least partially composed of air-permeable material.

28. The battery assembly of claim 24, wherein said enclosure is at least partially composed of moisture-proof material.

29. The battery assembly of claim 24, wherein said enclosure is composed of thermoformed material.

30. The battery assembly of claim 24, wherein said enclosure is composed of plastic or like material.

31. The battery assembly of claim 24, wherein said enclosure is composed of silicone or like material.

32. The battery assembly of claim 24, wherein said enclosure has a thickness not exceeding 0.3 mm.

33. The battery assembly of claim 24, wherein said enclosure is configured and sized to provide a substantial air space dimension between said enclosure and said ear canal when said battery assembly is inserted into said ear canal, for minimizing occlusion thereof.

34. The battery assembly of claim 24, wherein said enclosure is configured and sized to enable full insertion of said battery assembly to or beyond the bony-cartilaginous junction area of the ear canal.

35. The battery assembly of claim 24, wherein said battery is a button cell type battery.

36. The battery assembly of claim 24, wherein said enclosure is configured and adapted to align the long axis of said enclosed battery along the long axis of the oval ear canal.

37. A self-supporting battery assembly for powering an ear canal hearing device, comprising:

a thin walled battery enclosure configured to conform closely to the shape of and to exclusively surround a battery removably contained therein, said enclosure further configured to be separable relative to other enclosures of said hearing device, so that when the hearing device is inserted into the ear canal with the battery assembly attached thereto said battery enclosure is generally spaced-apart from the wall of the canal to avoid occlusion thereof.

* * * * *